US005090345A

United States Patent [19]

Ogawa

[11] Patent Number: 5,090,345

[45] Date of Patent: Feb. 25, 1992

[54] THREADING APPARATUS ON A SEWING MACHINE

[75] Inventor: Masao Ogawa, Nagoya, Japan

[73] Assignee: Brother Kogyo Kabushiki Kaisha, Aichi, Japan

[21] Appl. No.: 579,961

[22] Filed: Sep. 10, 1990

[30] Foreign Application Priority Data

Oct. 14, 1989 [JP] Japan ..... 1-267857

[51] Int. Cl.[5] ..... D05B 87/02

[52] U.S. Cl. ..... 112/225; 112/221

[58] Field of Search ..... 112/220, 224, 225, 238, 112/240, 241, 254, 284, 302

[56] References Cited

U.S. PATENT DOCUMENTS

| | | | |
|---|---|---|---|
| 2,704,526 | 3/1955 | Benink et al. | 112/225 |
| 2,727,479 | 12/1955 | Meissler | 112/225 |
| 2,739,553 | 3/1956 | Zink et al. | 112/225 |
| 2,815,727 | 12/1957 | Clauss et al. | 112/225 |
| 2,910,029 | 10/1959 | Herbst | 112/225 |
| 3,002,476 | 10/1961 | Capelli | 112/225 |
| 4,355,591 | 10/1982 | Itoh et al. | 112/225 |
| 5,003,899 | 4/1991 | Ogawa | 112/225 X |

FOREIGN PATENT DOCUMENTS 1113092 5/1989 Japan .

*Primary Examiner*—Werner H. Schroeder
*Assistant Examiner*—Ismael Izaguirre
*Attorney, Agent, or Firm*—Oliff & Berridge

[57] ABSTRACT

In a threading apparatus on a sewing machine, the drive source is driven and transmits drive force through a transmission to a moving board. The moving board thus lowers and contacts the actuating rod. The actuating rod in turn lowers, thereby lowering and further rotating the threading rod. The threading hook enters the needle eye. The needle is thus threaded. The moving board is provided separately from the actuating rod. When the drive source or the transmission breaks, the actuating rod can be lowered separately from the moving board. Specifically, without driving the drive source, the actuating rod can manually be lowered, so that the threading rod can lower and rotate, and the threading hook is inserted into the needle eye. Since the needle can thus manually be threaded, the position adjustment in the assembling the threading apparatus is facilitated.

20 Claims, 3 Drawing Sheets

THREADING APPARATUS ON A SEWING MACHINE

BACKGROUND OF THE INVENTION

This invention relates to a threading apparatus on a sewing machine for facilitating of the threading of a needle.

Such threading apparatus is proposed, for example, in Japan Published Unexamined Patent Application No. H1-113092, in which a spring raises an actuating rod and an air cylinder lowers the actuating rod. When the actuating rod lowers, a threading rod lowers and further rotates, a threading hook enters a needle eye, and thread is caught in the threading hook. The threading hook leaves the needle eye, thereby drawing one end of the thread into and through the needle eye.

However, in the related-art threading apparatus the actuating rod is connected to the air cylinder through string members. If the air cylinder fails to operate because of the breakage of the air cylinder or an incorrect supply of air to the air cylinder, the actuating rod also fails to operate. The actuating rod can be lowered only by means of the air cylinder. Therefore, when the air cylinder breaks, a needle cannot be threaded with the threading hook.

The threading apparatus should be assembled by placing the threading hook and the needle eye in a predetermined relative position so that the threading hook can be inserted through the needle eye. For example, when the needle is in the predetermined position, the threading rod lowered by the actuating rod is prevented through a positioning stop member or the like from lowering further, and the threading hook is aligned with the needle eye. The actuating rod further lowers, the threading rod rotates, and the threading hook goes through the needle eye. When the threading apparatus is assembled, the position of the positioning stop member is adjusted so that the threading hook can be aligned with the needle eye. The threading hook is aligned with the needle eye by vertically moving the threading hook. For such adjustment, the air cylinder is driven. Alternatively, the air cylinder is disconnected from the actuating rod, the threading rod is manually moved to align the threading hook with the needle eye, and the air cylinder is again connected to the actuating rod. The position adjustment is a time-consuming operation.

SUMMARY OF THE INVENTION

The object of this invention is to provide a threading apparatus on a sewing machine that can thread a needle by operating an actuating rod separately from an air cylinder. Even when the air cylinder breaks or when the threading apparatus is assembled and adjusted, the actuating rod can be operated without driving the air cylinder.

To attain this or other object, the present invention provides a threading apparatus for a sewing machine having a needle bar, a needle attached to one end of the needle bar, and a sewing transmission for moving the needle bar.

The threading apparatus comprises a threading rod mounted in parallel to the needle bar such that the threading rod is movable along and rotatable about an axis of the needle bar, a threading hook attached to the lower end of the threading rod, and an actuating rod.

The threading apparatus further comprises a moving board, a drive source and a spring. The moving board is provided separately from the actuating rod, moves vertically in parallel with the actuating rod and contacts the actuating rod when the moving board lowers. The drive source vertically moves the moving board through a transmission. The spring pulls up the actuating rod when the moving board contacts the actuating rod. The moving board lowers, the actuating rod lowers, the threading rod lowers and rotates, and the threading hook enters an eye in the needle. The needle is thus threaded.

DETAILED DESCRIPTION OF THE PREFERRED EMBODIMENT

Figure 1:
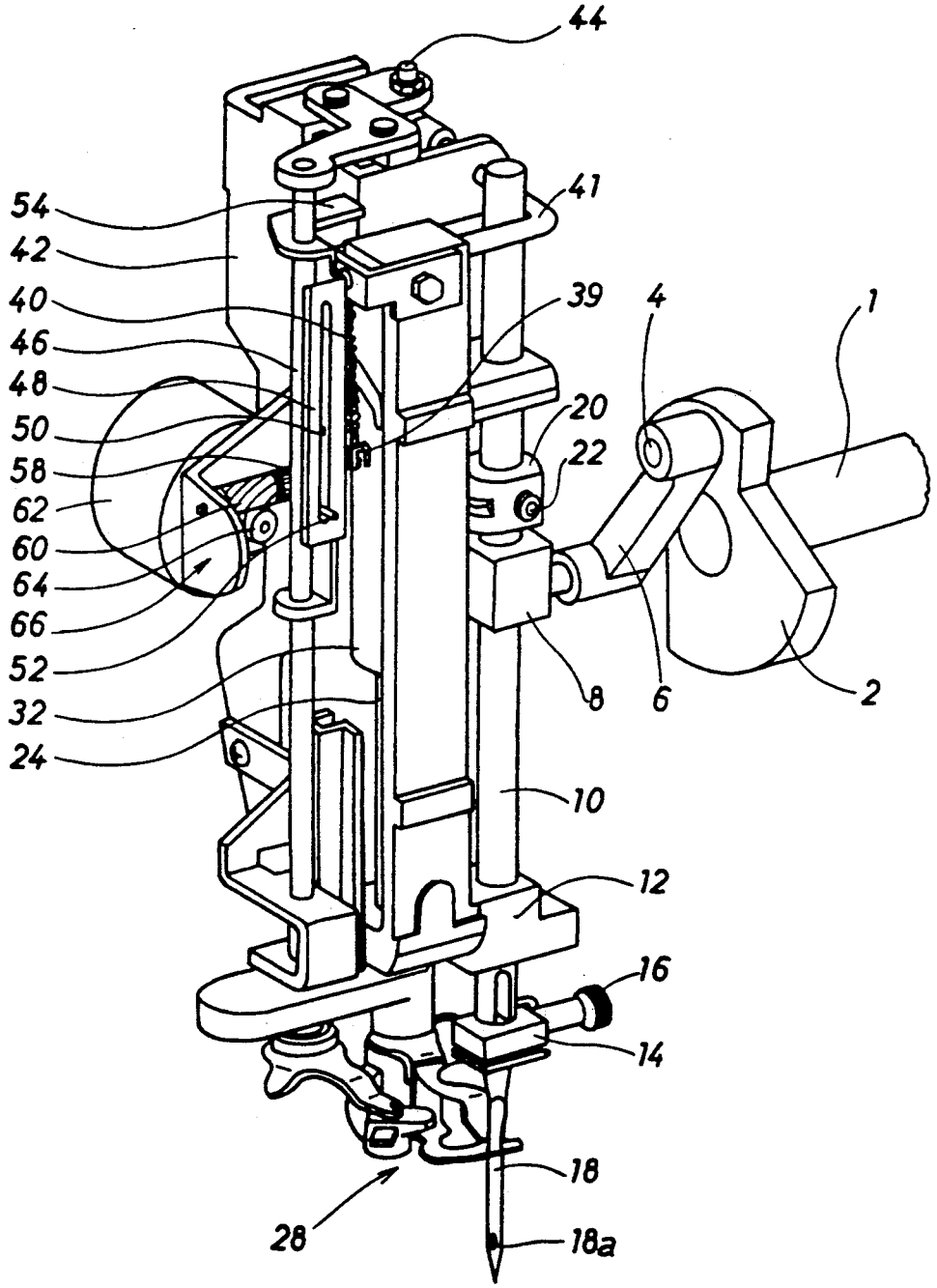
FIG. 1 is a perspective view of a threading apparatus on a sewing machine embodying the present invention.
Figure 2:
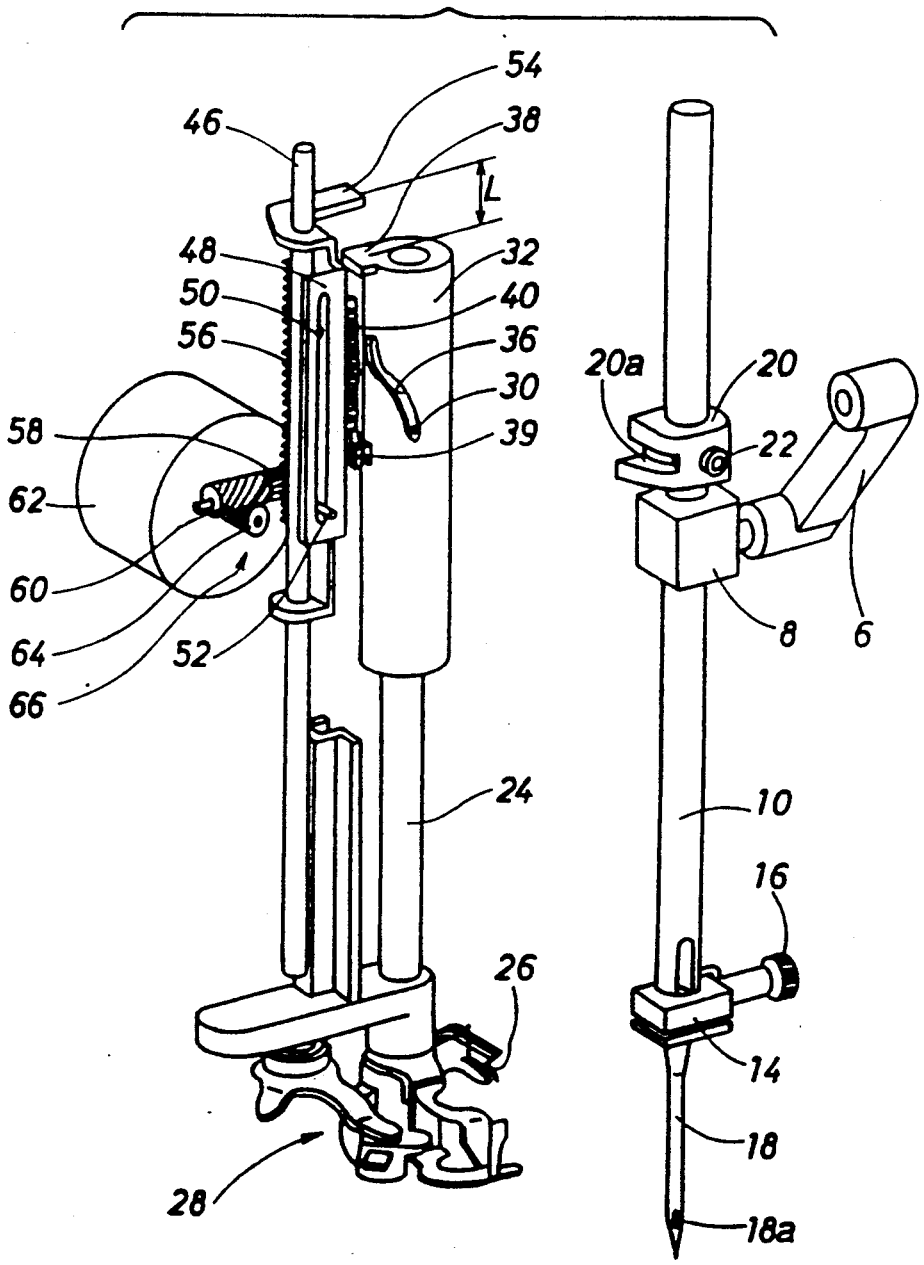
FIG. 2 is a perspective view of disassembled main parts of the threading apparatus for the embodiment.

As shown in FIGS. 1 and 2 a threading apparatus includes an arm shaft 1. The arm shaft 1 is rotated by a sewing machine motor (not shown). A crankpin 4 is provided on a counterbalance 2 attached to the arm shaft 1. One end of a connecting rod 6 is rotatably inserted into the crankpin 4. The other end of the connecting rod 6 is rotatably inserted into a needle bar connecting stud 8. The needle bar connecting stud 8 is secured to a needle bar 10. A needle bar support 12 supports the needle bar 10 such that the needle bar 10 can vertically slide. A needle 18 is attached via a needle connecting stud 14 and a clamp screw 16 to the lower end of the needle bar 10. A positioning stopper 20 is secured above the needle bar connecting stud 8 by a screw 22 onto the needle bar 10. As shown in FIG. 2, a projection **20*a* projecting perpendicularly to an axis of the needle bar 10 is formed on the positioning stopper 20**.

A threading rod 24 is supported on the needle bar support 12 in parallel with the needle bar 10 so that the threading rod 24 can rotate about its axis and can vertically slide. A threading hook 26 is provided on the lower end of the threading rod 24. When the threading rod 24 rotates, a known linkage 28 rotates the threading hook 26 toward an eye **18*a* in the needle 18**.

Figure 3:
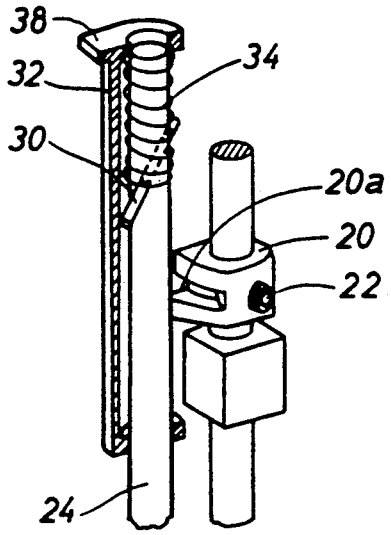
FIG. 3 is a partial perspective view of a positioning stopper for the embodiment.

As shown in FIG. 3, an actuating pin 30 is inserted through the upper end of the threading rod 24 such that the actuating pin 30 is perpendicular to the axis of the threading rod 24. When the threading rod 24 lowers, the actuating pin 30 touches the projection **20*a* of the positioning stopper 20 to stop the threading rod 24. The positioning stopper 20 is secured by the screw 22 at a predetermined position on the needle bar 10 such that when the actuating pin 30 touches the projection 20*a*, the threading hook 26 is aligned with the eye 18*a* in the needle 18**.

A hollow actuating rod 32 is slidably inserted onto the threading rod 24. A compression spring 34 interposes between the actuating pin 30 and the hollow actuating rod 32. As shown in FIG. 2, a guide slot 36 forms an S-shaped arc extending upward along the outer periphery of the hollow actuating rod 32. One end of the actuating pin 30 engages the guide slot 36. A contact surface 38 is formed on the upper end of the hollow actuating rod 32 and projects from the radius of the threading rod 24. A hook 39 is formed on the outer periphery of the hollow actuating rod 32. A spring 40 extends between the hook 39 and a hook (not shown) formed as one piece with a moving board 48. The spring 40 exerts an upward force to the hollow actuating rod 32.

As shown in FIG. 1, one end of an L-shaped member 41 is rotatably attached to the upper end of the needle bar support 12. The other end of the L-shaped member 41 is rotatably attached by a screw 44 into a threading housing 42 secured to a sewing-machine housing (not shown). A guide bar 46 is secured in parallel with the threading rod 24 onto the threading housing 42. The moving board 48 is slidably attached to the guide bar 46, separate from the hollow actuating rod 32.

The moving board 48 includes a slot 50 extending along the sliding direction of the moving board 48. A pin 52 on the guide bar 46 engages the slot 50, thus preventing the moving board 48 from rotating. A projection 54 is formed on the upper end of the moving board 48. When the moving board 48 slides down toward the hollow actuating rod 32, the projection 54 touches the contact surface 38 of the hollow actuating rod 32 at a certain point. This embodiment has a structure such that the projection 54 is a predetermined distance L away from the contact surface 38, when the moving board 48 is in its uppermost position as shown in FIG. 2. However, the projection 54 can be in contact with the contact surface 38, when the moving board 48 is in its uppermost position.

The moving board 48 includes a rack 56. The teeth of the rack 56 are formed in the sliding direction of the moving board 48. The rack 56 meshes with a pinion 58. The pinion 58 and a helical gear 60 form one member and are rotatably supported on the threading housing 42. A worm gear 64 is attached to a rotating shaft of a pulse motor 62 on the threading housing 42 such that the worm gear 64 meshes with the helical gear 60. The pulse motor 62 composes a drive source, and the worm gear 64, the helical gear 60, the pinion gear 58, and the rack 56 compose a transmission 66.

In operation, when power is turned on, an operator presses a threading switch (not shown) to thread the eye 18*a* in the needle 18 with thread 68 prior to sewing. In this embodiment, as shown in FIG. 1, the arm shaft 1 is first driven and the needle bar 10 is raised to its uppermost position. When the needle bar 10 reaches its uppermost position, the arm shaft 1 is stopped. When a sensor or other element detects that the needle bar 10 is in its uppermost position, a signal with a predetermined number of pulses is transmitted to the pulse motor 62 and the pulse motor 62 rotates. The rotation of the pulse motor 62 is transmitted through the transmission 66 such as the worm gear 64, the helical gear 60, the pinion 58, and the rack 56 to the moving board 48. The moving board 48 thus lowers along the guide bar 46.

When the moving board 48 lowers, the projection 54 also lowers the predetermined distance L and contacts the contact surface 38 of the hollow actuating rod 32, and the hollow actuating rod 32 in turn lowers. At the same time, the compression spring 34, the guide slot 36, and the actuating pin 30 move the threading rod 24 downward. The linkage 28 and the threading hook 26 also lower.

When the threading rod 24 lowers, the actuating pin 30 lowers, and the end of the actuating pin 30 touches the projection 20*a* of the positioning stopper 20. However, since the arm shaft 1 is stopped, the needle bar 10 as well as the connecting rod 6 and the needle bar connecting stud 8 are stopped in position. Therefore, the threading rod 24 is prevented from lowering further. When the moving board 48 further lowers, the hollow actuating rod 32 lowers against force applied by the compression spring 34. At the same time, the actuating pin 30 lowers along the guide slot 36, and the threading rod 24 is rotated.

Figure 4:
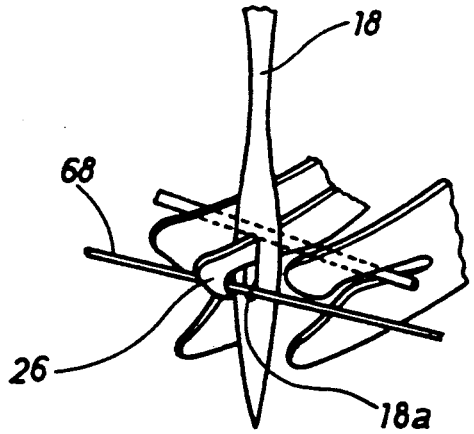
FIG. 4 is a perspective view of a threading hook inserted into an eye in a needle for the embodiment.

When the threading rod 24 is rotated by the actuating pin 30, the threading hook 26 is rotated through the linkage 28, and, as shown in FIG. 4, the threading hook 26 enters the eye 18*a* in the needle 18.

When the threading hook 26 enters the eye 18*a*, the pulse motor 62 receives the signal having the predetermined number of pulses and rotates in reverse. Such rotation of the pulse motor 62 is transmitted through the transmission 66 and the moving board 48 is raised. The hollow actuating rod 32 also rises using the tensile force of the spring 40. At the same time, the guide slot 36 rises and the threading rod 24 is rotated in reverse through the actuating pin 30. Therefore, the threading hook 26 is rotated by the linkage 28 and is pulled out of the eye 18*a*. When the threading hook 26 comes out of the eye 18*a*, one end of the thread 68 held by the threading hook 26 is drawn from the eye 18*a*. The eye 18*a* in the needle 18 is thus threaded.

When the moving board 48 further rises, the hollow actuating rod 32 also rises further using the tensile force of the spring 40. When the actuating pin 30 engages the lower end of the guide slot 36, the threading rod 24 is pulled up. The pulse motor 62 rotates according to the number of pulses of the signal. The moving board 48 then rises to its uppermost position. The threading rod 24 rises together with the hollow actuating rod 32.

Subsequently, when one end of the thread 68 is drawn from the eye 18*a* and the arm shaft 1 is again rotated, the rotation of the arm shaft 1 is converted to the vertical movement of the needle bar 10 through the connecting rod 6. The needle bar 10 vertically moves and starts sewing.

As aforementioned, in the threading apparatus on the sewing machine for this embodiment, when the pulse motor 62 is driven, the rotation of the pulse motor 62 is transmitted through the transmission 66, thereby lowering the moving board 48. The projection 54 of the moving board 48 contacts the contact surface 38 of the hollow actuating rod 32, and the moving board 48 in turn lowers the hollow actuating rod 32. The threading rod 24 also lowers, rotates and rotates the threading hook 26. The threading hook 26 goes through the eye 18*a* in the needle 18, thereby threading the eye 18*a*. After threading, the moving board 48 rises, the hollow actuating rod 32 rises using the tensile force of the spring 40, and the threading rod 24 rotates in reverse and rises.

Consequently, when the moving board 48 vertically slides, the hollow actuating rod 32 also vertically slides. Since the moving board 48 is separated from the hollow actuating rod 32, if the hollow actuating rod 32 is manually lowered without driving the pulse motor 62, the threading rod 24 can lower and rotate, thereby inserting the threading hook 26 into the eye 18*a*. Therefore, even when the pulse motor 62 or the transmission 66 breaks, the eye 18*a* in the needle 18 can be threaded through the threading hook 26 by manually lowering the hollow actuating rod 32.

When the threading apparatus is assembled, the positioning stopper 20 can be attached to the needle bar 10 with the screw 22 by manually lowering the hollow actuating rod 32 without driving the pulse motor 62. The positioning stopper 20 can thus easily and manually be adjusted to the predetermined position where, with the actuating pin 30 contacting the projection 20*a*, the threading hook 26 is aligned with the eye 18*a* in the needle 18. The positioning stopper 20 can be positioned without driving the pulse motor 62.

If the thread 68 is thicker than the eye 18*a*, the threading hook 26 with the thread 68 is caught in the eye 18*a*. When the size of the eye 18*a* and the thread 68 is thus incorrectly selected, in this embodiment, only the moving board 48 is raised through the pulse motor 62 and the threading hook 26 stays in the eye 18*a*. Since no raising force is applied to the threading hook 26, the threading hook 26, even if caught in the eye 18*a*, fails to break.

When the pulse motor 62 lowers the moving board 48 and the hollow actuating rod 32, no force of the spring 40 works on the hollow actuating rod 32 and the spring 40 also lowers. Consequently, load on the pulse motor 62 is reduced.

A preferred embodiment of the present invention is above described in detail. The present invention is not, however, limited to the embodiment above. Obviously, many modifications of the present invention are possible in the light of the above teachings. For example, the spring 40 extends between the hollow actuating rod 32 and the moving board 48. However, the spring 40 can extend between the hollow actuating rod 32 and the needle bar support 12 or between the hollow actuating rod 32 and the sewing machine housing.

What is claimed is:

1. A threading apparatus for a sewing machine comprising:

a needle bar;

a needle attached to one end of the needle;

a sewing transmission for moving the needle bar;

a threading rod mounted in parallel to the needle bar such that the threading rod is movable along and rotatable about an axis of the threading rod;

stop means mounted on the needle bar for stopping the threading rod when the threading rod is in a threading position adjacent to the needle;

threading means attached to a first end of the threading rod for extending a threading hook when the threading rod rotates about the threading rod axis;

actuating means mounted on a second end of the threading rod for rotating the threading rod about the threading rod axis when the threading rod is in the threading position;

movable member provided in parallel to the threading rod axis having a contact portion which selectively comes into contact with and is separated from the actuating means; and drive means for moving the movable member towards the threading position, wherein the contact portion contacts the actuating means to move the actuating means and the threading rod towards the threading position.

2. The threading apparatus of claim 1, wherein the actuating means comprises:

an actuating cylinder having one closed end mounted on the second end of the threading rod such that the threading rod reciprocates within the actuating cylinder;

an actuating rod fixed to and extending from the threading bar through a slot in the actuating cylinder; and an elastic member mounted within the actuating cylinder between the closed end of the actuating cylinder and the threading rod such that the elastic member forces the threading rod towards the threading position; wherein the slot is formed in the actuating cylinder such that the slot acts on the actuating rod to rotate the threading rod when the threading rod compresses the elastic member.

3. The threading apparatus of claim 1, wherein the threading rod such that the movable member is movable along a path parallel to the threading rod axis.

4. The threading apparatus of claim 1, wherein:

the drive means further moves the movable member away from the threading position; and the movable member does not contact the actuating means when the drive means moves the movable member away from the threading position.

5. The threading apparatus of claim 1, further comprising:

elastic retracting means attached at a first end to the movable member and at a second end to the actuating means; wherein the drive means further moves the movable member away from the threading position; and the elastic retracting means retracts the actuating means away from the threading position when the drive means moves the movable member away from the threading position.

6. The threading means of claim 1, wherein the actuating means comprises:

an actuating rod fixed to and extending from the threading bar; wherein the actuating rod contacts the stop means to stop the threading bar when the threading bar is in the threading position.

7. The threading apparatus of claim 1, wherein the drive means further comprises:

a drive source for providing rotational motion; and a transmission for transferring the rotational motion of the drive source into linear motion for driving the movable member.

8. The threading apparatus of claim 1, wherein the sewing transmission fixes the needle bar in a predetermined position away from a fabric before the threading bar is moved into the threading position.

9. A threading apparatus for a sewing machine having a needle bar, a needle attached to one end of the needle bar, and a sewing transmission for moving the needle bar, the threading apparatus comprising:

a threading rod mounted in parallel to the needle bar such that the threading rod is movable along and rotatable about an axis of the threading rod;

threading means attached to a first end of the threading rod for extending a threading hook when the threading rod rotates about the threading rod axis;

an actuating cylinder having one closed end mounted on a second end of the threading rod such that the threading rod reciprocates within the actuating cylinder;

an actuating rod fixed to and extending from the threading bar through a slot in the actuating cylinder; and an elastic member mounted within the actuating cylinder between the closed end of the actuating cylinder and the threading rod such that the elastic member forces the threading rod towards the threading position;

drive means for moving a drive board relative to the needle bar towards the threading position, wherein the drive board contacts the actuating means to move the actuating cylinder and threading rod towards the threading position; and stop means mounted on the needle bar for stopping the threading rod by contacting the actuating rod when the threading rod is in the threading position; wherein the drive board moves the actuating cylinder towards the threading position relative to the threading rod by compressing the elastic member when the stop means stops the threading rod in the threading position; and the slot is formed in the actuating cylinder such that the slot acts on the actuating rod to rotate the threading rod when the elastic member is compressed.

10. The threading apparatus of claim 9, in which the drive board has a contacting projection for contacting the closed end of the actuating cylinder and is mounted in parallel with the threading rod such that the drive board is movable along a path parallel to the threading rod axis.

11. The threading apparatus of claim 10, in which:

the drive means further moves the drive board away from the threading position; and the contacting projection does not contact the actuating cylinder when the drive means moves the drive board away from the threading position.

12. The threading apparatus of claim 11, further comprising:

elastic retracting means attached at a first end to the drive board and at a second end to the actuating cylinder; wherein the drive means further moves the drive board away from the threading position; and the elastic retracting means retracts the actuating cylinder away from the threading position when the drive means moves the drive board away from the threading position.

13. The threading apparatus of claim 12, wherein the drive means further comprises:

a drive source for providing rotational motion; and a transmission for transferring the rotational motion of the drive source into linear motion for driving the drive board.

14. The threading apparatus of claim 13, wherein the actuating cylinder is moved towards the threading position by providing a manual force on the actuating cylinder towards the threading position greater than the force exerted by the retracting means.

15. The threading apparatus of claim 14, wherein the sewing transmission fixes the needle bar in a predetermined position away from a fabric before the threading bar is moved into the threading position.

16. A threading apparatus for a sewing machine having a needle bar, a needle attached to one end of the needle bar, and a sewing transmission for moving the needle bar, the threading apparatus comprising:

a threading rod mounted on a threading housing in parallel to the needle bar such that the threading rod is movable along and rotatable about an axis of the threading rod;

threading means attached to a first end of the threading rod for extending a threading hook when the threading rod rotates in a first direction about the threading rod axis and for retracting the threading hook when the threading rod rotates about the threading rod axis in a second direction opposite to the first direction;

an actuating cylinder having one closed end mounted on a second end of the threading rod such that the threading rod reciprocates within the actuating cylinder;

an actuating rod fixed to and extending from the threading bar through a slot in the actuating cylinder; and an elastic member mounted within the actuating cylinder between the closed end of the actuating cylinder and the threading rod such that the elastic member forces the threading rod towards the threading position;

linear drive means mounted on the threading housing for moving a drive board relative to the needle bar, wherein the drive board is movably mounted on the threading housing such that the drive board contacts the actuating means to move the actuating cylinder and threading rod towards the threading position when the drive means drives the drive board in a first direction towards the threading position;

elastic retracting means attached at a first end to the drive board and at a second end to the actuating cylinder; and stop means mounted on the needle bar for stopping the threading rod by contacting the actuating rod when the threading rod is in the threading position; wherein the drive board moves the actuating cylinder towards the threading position relative to the threading rod by compressing the elastic member when the stop means stops the threading rod in the threading position;

the slot is formed in the actuating cylinder such that the slot acts on the actuating rod to rotate the threading rod about the threading rod axis in the first direction when the elastic member is compressed;

the drive means further moves the drive board away from the threading position; and the elastic retracting means retracts the actuating cylinder away from the threading position when the drive means moves the drive board away from the threading rod to rotate the threading rod about the threading rod axis in the second direction.

17. The threading apparatus of claim 16, wherein the drive board comprises:

a slot running lengthwise along the drive board through which a guide pin fixed relative to the threading housing protrudes for guiding the drive board along a path parallel to the threading rod axis; and a contacting projection for contacting the closed end of the actuating cylinder when the drive board moves towards the threading position, where the contacting projection does not contact the actuating cylinder when the drive means moves the drive board away from the threading position.

18. The threading apparatus of claim 17, wherein the drive means further comprises:

a drive source for providing rotational motion; and a transmission for transferring the rotational motion of the drive source into linear motion for driving the drive board.

19. The threading apparatus of claim 18, wherein the actuating cylinder is moved towards the threading position by providing a manual force on the actuating cylinder towards the threading position greater than the force exerted by the retracting means.

20. The threading apparatus of claim 19, wherein the sewing transmission fixes the needle bar in a predetermined position away from a fabric before the threading bar is moved into the threading position.

* * * * *